United States Patent [19]

Propst et al.

[11] 4,257,203

[45] Mar. 24, 1981

[54] UNDER THE WALL WIRING SYSTEM WITH IMPROVED COVER MEMBERS

[75] Inventors: Robert L. Propst, Ann Arbor; Michael A. Wodka, Ypsilanti; Thomas J. Newhouse, Grand Rapids, all of Mich.

[73] Assignee: Herman Miller, Inc., Zeeland, Mich.

[21] Appl. No.: 958,192

[22] Filed: Nov. 6, 1978

[51] Int. Cl.[3] ..... E04F 17/08; E04F 19/04

[52] U.S. Cl. ..... 52/221; 52/242; 339/23

[58] Field of Search ..... 52/221, 242, 290, 716; 339/23; 174/48

[56] References Cited

U.S. PATENT DOCUMENTS

| | | | |
|---|---|---|---|
| 3,676,974 | 7/1972 | Daly | 52/221 |
| 4,031,675 | 6/1977 | Roberts | 52/221 |
| 4,043,626 | 8/1977 | Propst | 52/242 |

*Primary Examiner*—John E. Murtagh

*Attorney, Agent, or Firm*—Olsen and Stephenson

[57] ABSTRACT

Side cover members positionable along the base of a movable wall panel for concealing a utility space below the lower edge of the wall panel in which electrical and telephone cables are disposed. Each side cover member consists of a main body having sections that are formed of yieldable material. The cover members are arranged end to end along the base of the wall panel with the yieldable end sections of adjacent cover members being positioned in a juxtaposed relationship with each other. The yieldable end sections enable the cables to be extended from the utility space between adjacent end sections whereby only the portions of the yieldable end sections in close proximity to the cables are deformed.

3 Claims, 4 Drawing Figures

UNDER THE WALL WIRING SYSTEM WITH IMPROVED COVER MEMBERS

BACKGROUND OF THE INVENTION

The present invention relates to applicant's U.S. Pat. No. 4,043,626 and application Ser. No. 825,655, filed Aug. 18, 1977, now abandoned both of which disclose under the wall energy distribution systems for a space divider system in which a plurality of modular offices or work stations are erected. These under the wall energy distribution systems house the electrical and telephone cables beneath the wall panels of the space divider system. Thus, power and communication service is available within each office or work station. Under the wall energy distribution systems are advantageous in that the portability of the space divider system is maintained. Also, the electrical and telephone cables, by being located under the wall panels, are unnoticeable.

As disclosed in the above-identified patent and application, the wall panels are supported by legs which establish a utility space beneath the wall panels in which the cables are disposed. Side cover members are employed to conceal the utility space, presenting an appearance of a continuous wall panel extending upwardly from the floor.

Since modular offices are assembled on location and since final adjustments are usually made at this time, such as the height of the wall panels, it is desirable to provide a number of components of the system whose final configuration is formed at the time of assembly. Such components add flexibility to the construction of the modular office system. One component which can be constructed to meet these objectives is the side cover member.

It is also desirable to provide the under the wall energy distribution system with suitable access passageways through which the cables can be extended from the utility space. It is advantageous from the standpoint of safety and appearance to maintain continuity between adjacent side cover members while maintaining the cable in a relatively fixed position at the location where the cables extend from the utility space.

It is the general object of the present invention, therefore, to provide an improved side cover member for use with an under the wall energy distribution system.

It is a further object of the present invention to provide an improved side cover member having at least one end section of deformable material.

It is yet another object of the present invention to provide an improved side cover member constructed so that it can be modified on location.

SUMMARY OF THE INVENTION

In accordance with the present invention, an improved side cover member is disclosed consisting of a main body portion having end sections formed of yieldable material such as polyurethane foam. Generally, the main body portion is constructed of suitable plastic material which can be matched in texture and color with the wall panels of a space divider system. The end sections are suitably attached such as by adhesive to the inner surface of the main body portion and extend beyond the ends of the main body portion. The end sections have a cross-sectional configuration that generally conforms to the cross-sectional configuration of the main body portion of the cover member to give the side cover member a unitary appearance.

The side cover members are used in a space divider system consisting of wall panels arranged end to end and supported by depending legs which can be adjusted to vary the height of each wall panel. Base plates are disposed on the floor and receive the legs of the wall panel. The cover members attach to the base plates and are maintained in upright positions to conceal the utility space below the bottom edges of the wall panels formed by virtue of the depending wall panel legs.

The side cover members are arranged on the base plates end to end so that the end sections of adjacent cover members are in an abutting relationship. The juncture between the adjacent end sections provides a break or passageway through which the electrical and telephone cables are extended. These cables are disposed within the utility space below the wall panels so as to provide electrical communication service along the perimeter of each modular office.

The deformable end sections of the side cover members are deformed only in the vicinity where the cables are extended between adjacent side cover members so as to provide the appearance of a single continuous cover member extending along the entire wall. Also, because the cables are squeezed between adjacent end sections they are held firmly in place. Since the end sections are formed of yieldable material, portions can be cut away to form an enlarged opening to receive larger objects such as an outlet, for instance. Since the exact height of the wall panel is usually determined only at the time when the office is assembled on location, the final cutting of the end sections can be performed at this time so as to permit greater freedom to the installer in determining the final positioning of the wall sockets. Accordingly, the side cover members of the present invention give the user additional flexibility in constructing the space divider system.

Further objects, features and advantages of the present invention will become apparent from a consideration of the following description when taken in connection with the appended claims and the accompanying drawing in which:

Figure 1:
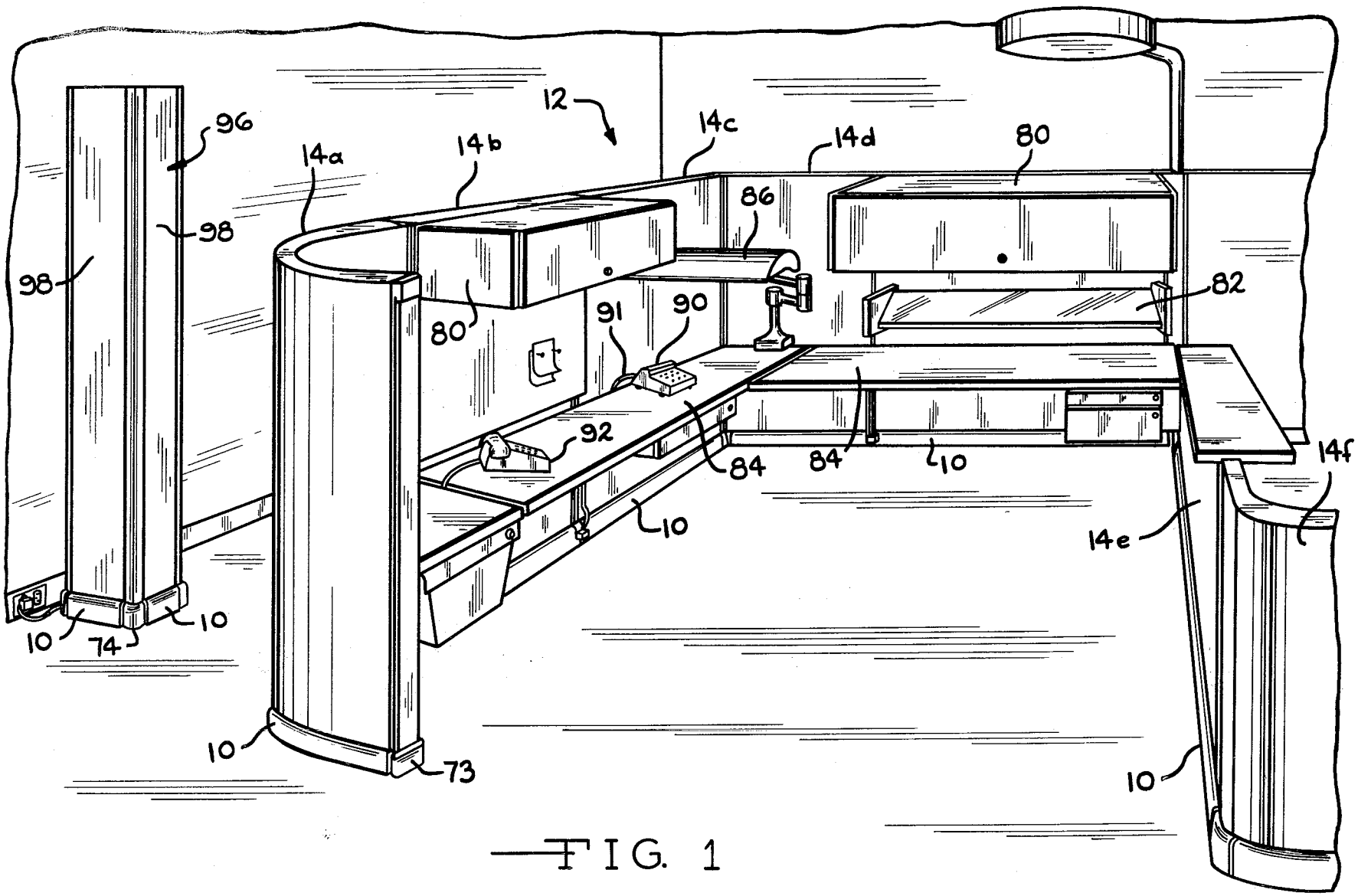
FIG. 1 is a perspective view of a modular office or work station positioned in a room and having an under the wall energy wiring system with the side cover members of the present invention positioned end to end along the base of the wall panels.

With reference to the drawing, the side cover members of the present invention, indicated generally at 10 in FIG. 1, are incorporated into a space divider system which forms modular offices or work stations 12 that are assembled within a larger room. As shown in FIG. 1, one modular office 12 or work station is provided comprising a plurality of wall panels 14 having lower edges 15 with individual panels being designated by the reference numerals 14*a* through 14*f*. The wall panels 14 are arranged end to end to form the desired configuration of the work station and may include curved panels such as the panel 14*a*. The panels 14 can be arranged in a straight line or at an angle with respect to each other such as exists between panels 14*c* and 14*d*.

Figure 3:
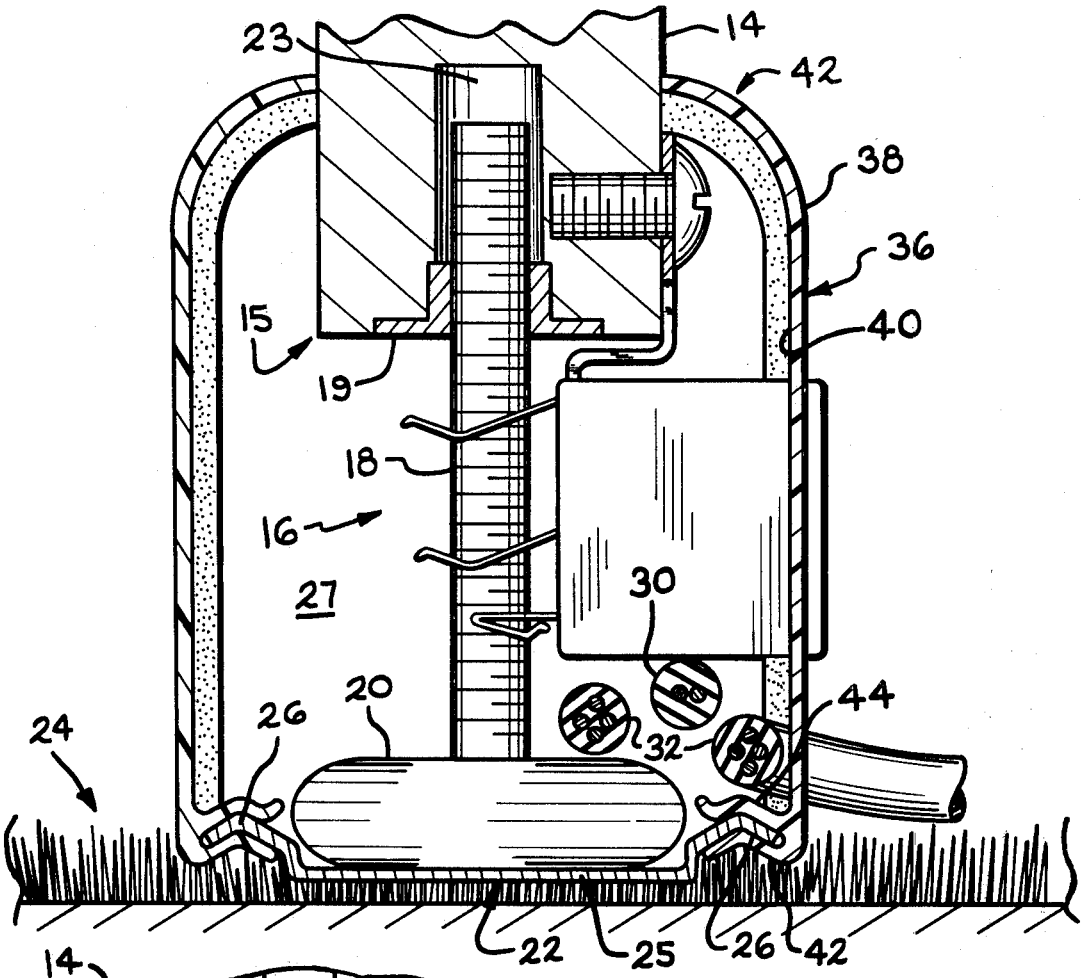
FIG. 3 is a sectional end view of a wall panel and energy distribution system taken substantially from line 3—3 in FIG. 2.

As shown in FIG. 3, each wall panel 14 is supported by depending legs 16 (one shown), each having a threaded spindle 18 threadably mounted at one end to a bracket 19 and affixed at the other end to a glide 20. The bracket 19 is suitably secured to the panel 14 in alignment with an opening 23. Rotation of the spindle 18 varies the distance between the glide 20 and the panel 14 thereby adjusting the height of the panel 14 on the floor. Base plates 22 are positioned on the floor 24 and receive the glides 20 of the legs 16. Each base plate 22 has a flat support portion 25 and transversely displaced flange portions 26 on which the side cover members 10 are mounted. The positioning of each wall panel 14 so that its lower edge 15 is spaced above the floor 24 establishes a utility space 27 beneath that wall panel 14 between its bottom edge 15 and the base plate 22. Electrical cables 30 and telephone cables 32 are disposed in the utility space 27 to run along the perimeter of the modular office 12 making power and communication service available throughout each modular office or work station 12.

Each side cover member 10 of the present invention consists of a main body portion 36 having an inner surface 38 and an outer surface 40. A top portion 42 extends generally transversely from the main body portion 36 so that when the cover member is positioned in an upright orientation, the main body portion 36 is generally upright while the top portion 42 engages the wall panel 14 to conceal the utility space 27. Coacting means on the main body portion 36 at its lower end and the flange 26 of the base plates 22 cooperate to maintain the side cover member 10 in its upright operative position. The coacting means consist of a pair of angled leg members 42 and 44 which are constructed of flexible material and which straddle the flange 26. The legs 42 and 44 conform generally to the configuration of each angled flange 26 which first extends upwardly and transversely outwardly from the flat support portion 22 and then downwardly therefrom to form a generally inverted V-shaped configuration. The leg members 42 and 44 are mounted to the flange 26 in a clamping relationship to releasably hold each side cover 10 in an upright position.

Figure 2:
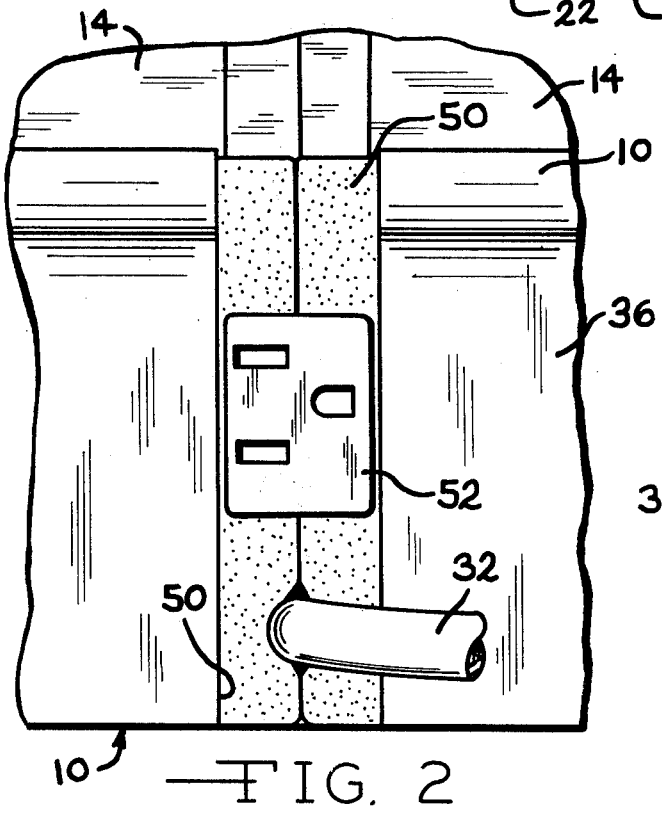
FIG. 2 is an enlarged fragmentary view in elevation of a pair of side cover members of the present invention located in a side by side relationship.

Each side cover 10 is provided with end sections 50 that are formed of yieldable or deformable material such as polyurethane foam and are suitably secured to the main body portion 36 such as with an adhesive. The end sections 50 have a cross-sectional configuration that is similar to the cross-sectional configuration of the main body portion 36 of the cover member 10. The side cover members 10 are arranged end to end along the base of the wall panel 14 to conceal the utility space 27. The end sections 50 of adjacent cover members 10 are in a juxtaposed relationship with each other and in the illustrated embodiment, are positioned in abutting relationship with each other. The break or discontinuity between adjacent end sections 50 enables the electrical and telephone cables to extend therebetween from the utility space to suitable equipment located within the modular office 12. As shown in FIG. 2, only the telephone cable 32 is extended from the utility space 27 and it compresses or deforms only those portions of the end sections 50 that are in close proximity to the cable 32 so that a generally continuous appearance is maintained between adjacent cover members 10. In other words, the deformable end sections 50 are squeezed against the telephone cable 32 to anchor it in a generally fixed position at the location where it exits between the adjacent side cover members 10. Yet, adjacent cover members 10 appear to be integrally formed with each other.

The yieldable end sections 50 can also be cut away by a suitable cutting tool to form an enlarged passageway communicating with the utility space 27. An electrical socket 52 (its connection to an electrical cable not shown) can thus be positioned in this passageway so that its face is generally flush with the outer surfaces 38 of the cover member 10 as is best seen in FIGS. 2 and 3. The outlet 52 is mounted on the wall panel 14 by an offset bracket 54 and a screw 56. Since the outlet 52 is generally fixed relative to the wall panel 14, its height will depend on the final adjustment of the height of the wall panel 14 to which it is attached. Thus, only when the final height of the wall panel 14 is determined will the passageway for the outlet 52 be cut away. The user therefore has the ability to make the final adjustments as to the height of the wall panels 14 and the location and positioning of the outlet 52.

Figure 4:
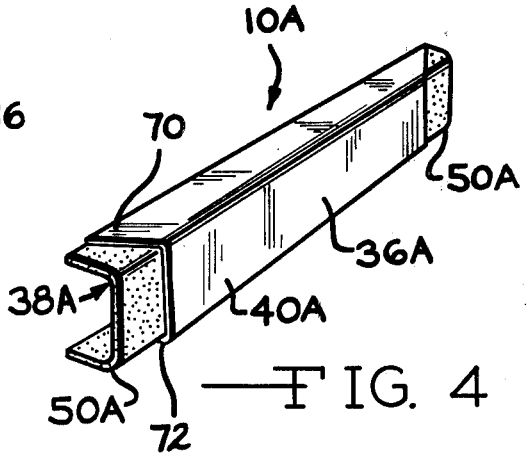
FIG. 4 is a perspective view of a modified side cover member.

In FIG. 4, a modified side cover member 10A is shown having a generally inverted C-shaped configuration with top and bottom legs 70 and 72 which are beveled at the ends of the main body portion 36A extending in a direction toward its front surface 40A. Similarly, C-shaped yieldable end sections 50A are suitably attached to the inner surface 38A of the side cover member 10A. The side cover members 10 or 10A may take various forms such as the curved cover member 10B shown in FIG. 1. Additionally, end cover members 73 and corner cover members 74 can be provided each having yieldable end sections.

As seen in FIG. 1, the modular office 12 has storage cabinets 80, display racks 82 and working counters 84 on which various equipment such as the critical task light 86 is used for those tasks in which the worker needs high intensity light in order to accomplish his work without eye strain. A calculator 90 having a cord 91 is shown plugged into a socket 52 that is disposed between adjacent cover members 10. Also, the telephone line 32 of the telephone 92 is connected to the energy distribution system under the wall panels 14 by being extended between adjacent side cover members 10 as shown in FIG. 2.

An ambient light fixture 96 is shown disposed in the room in which the modular offices 12 are located and is also provided with side cover members 10 which conceal the utility space that exists below the panels 98. Thus, the appearance and functional characteristics of the light fixture 96 are compatible with the rest of the modular office system.

From the above description, it can be seen that an improved side cover member is provided for use with an under the wall energy distribution or wiring system. By virtue of the provision of the yieldable end sections 50, telephone and electrical lines can extend from the utility spaces below the wall panels 14 with minimum deformation of the end sections occurring to maintain visual continuity between adjacent cover members 10. Also, the end sections 50 can be cut away at the time of their assembly to accommodate the particular location of the electrical socket 52 that is located so that its face is generally flush with the cover members 10.

What is claimed:

1. In a wall panel construction comprising a movable wall panel, said wall panel having ends and a bottom edge, means supporting a plurality of said wall panels in an end-to-end relationship on a supporting surface in which the bottom edge of each wall panel is located above the supporting surface to define a utility space below the bottom edges of said wall panels, said supporting means comprising a plurality of base members positioned end-to-end on said supporting surface, side cover members positioned end to end along the bottom edge of said wall panels to conceal said utility space, each of said side cover members comprising a main body having inner surface portions facing said walls and outer surface portions facing in the opposite direction, end sections formed of yieldable material affixed to the inner surface portions of said main body of each side cover member so as to extend beyond the ends of said main body, said side cover members being arranged so that the end sections of adjacent cover members are in a juxtaposed relationship with said end section on one side cover member abutting the end section on an adjacent side cover member to establish substantial continuity between adjacent side cover members, said end sections having cross sectional configurations that conform with the cross-sectional configuration of said main body to which said end sections are affixed so as to appear as integral extensions of said main body, said end sections being formed of yieldable material to enable the passage of an object between a pair of abutting end sections to and from said utility space while maintaining substantial continuity between said abutting end sections as said end sections are deformed only in the vicinity of said object, and coacting means on said base members and on said side cover members for mounting said cover members on said base members in positions to conceal said utility space.

2. The wall panel construction according to claim 1 wherein said coacting means comprises flange portions extending generally transversely outwardly from said base means, and spaced apart leg members on said side cover members straddling said flange portions so as to support said side cover members in generally upright positions.

3. The wall panel construction according to claim 1 further including an outlet mounted on one of said wall panels, means forming an opening in at least one of said end sections, said outlet being positioned in said opening so as to be essentially flush with the outer surface of said cover members.

* * * * *